United States Patent [19]

Ammirata

[11] 4,059,305

[45] Nov. 22, 1977

[54] SEAT AND FOOT REST TILTING CHAIR

[76] Inventor: Vincent T. Ammirata, 7 The Terrace, Middletown, N.J. 07748

[21] Appl. No.: 645,466

[22] Filed: Dec. 30, 1975

[51] Int. Cl.[2] ..... A47C 1/02

[52] U.S. Cl. ..... 297/338; 297/423; 297/DIG. 10

[58] Field of Search ..... 297/338, 332, 331, 335, 297/DIG. 10, 418, 377, 378, 423

[56] References Cited

U.S. PATENT DOCUMENTS

| | | | |
|---|---|---|---|
| 2,608,237 | 8/1952 | Lecroy | 297/335 |
| 2,679,893 | 6/1954 | Bennett | 297/423 X |
| 3,039,818 | 6/1962 | Frank | 297/DIG. 10 |
| 3,539,220 | 11/1970 | Aguilar | 297/DIG. 10 |
| 3,565,485 | 2/1971 | Eisenhauer | 297/423 X |
| 3,679,260 | 7/1972 | Morse-Brown | 297/338 |

FOREIGN PATENT DOCUMENTS

| | | | |
|---|---|---|---|
| 629,334 | 11/1927 | France | 297/338 |

*Primary Examiner*—Roy D. Frazier
*Assistant Examiner*—Darrell Marquette
*Attorney, Agent, or Firm*—Howard T. Jeandron

[57] ABSTRACT

An invalid chair for handicapped persons designed to facilitate sitting down and rising in which the seat of the chair and the footrest are a single frame and both are pivotally mounted to a front cross member so that the seat will be moved pivotally up and forward as the footrest moves down and back to thus assist the person in rising from the chair and vice versa the seat will move pivotally down and back as the footrest moves up and forward and in addition a plurality of resilient springs or stretchable straps will resist the downward movement of the seat to assist the invalid in a seating operation and resist the progressive upward pivotal movement of the chair's footrest. The chair when empty will be biased to hold the footrest down and seat up ready to accept a person on the footrest and when the person steps upon the footrest and leans back in a sitting position, the weight of the chair occupant will automatically produce a pivotal movement of the footrest and seat and be partially retarded in its pivotal movement by the resilient stretchable straps.

3 Claims, 2 Drawing Figures

SEAT AND FOOT REST TILTING CHAIR

SUMMARY

According to the present invention an invalid chair should be properly balanced with a pivotal movement of the seat and footrest to permit a patient to enter the chair by stepping upon the footrest and while holding the chair arm rails lean against the seat, gradually shifting his or her weight backward until the seat and footrest pivotally move allowing the patient and seat to settle down to a sitting position while raising the patient's feet slightly above the ground. The backward movement bringing the patient down and back to rest against the stationary back rest. A reverse action of rising is just as simple, the patient merely leans forward shifting weight and holding on to the arm rests, a slight pull on the arm rest will move the weight farther forward and cause the seat and footrest to pivotally move until the patient is in a standing position. The operation either sitting down or rising is assisted by a plurality of springs or stretchable straps attached under the seat to prevent a sudden drop of the seat when sitting and to bias the rising of the seat when the weight is shifted forward.

A primary object of this invention is to provide a chair for use by invalids or elderly people whose legs are not strong enough or flexible enough for the normal shift of position in sitting down and in rising.

Other objects of this invention shall become apparent by reference to the following detailed description and the drawings in which

Figure 1:
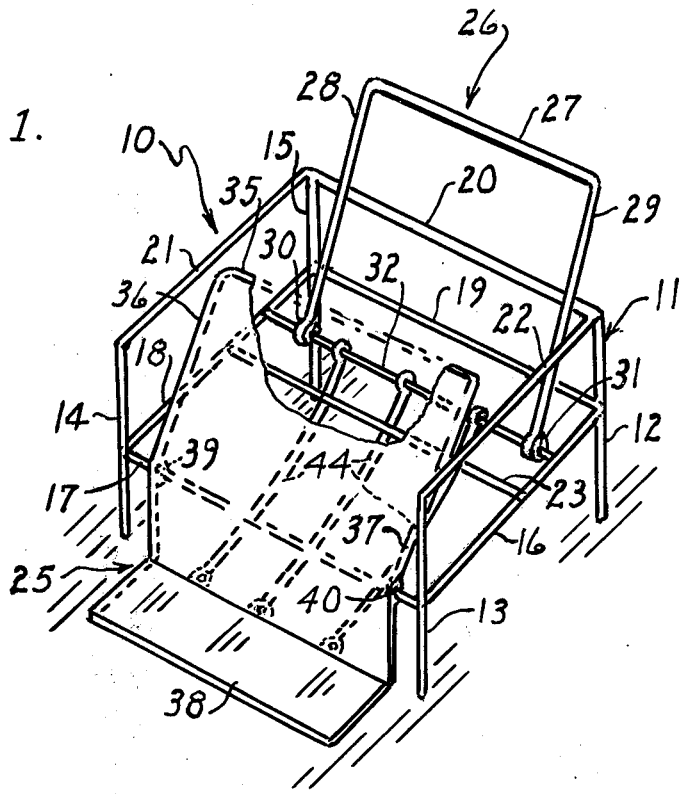
FIG. 1 illustrates a perspective view of the chair frame and its structural components.
Figure 2:
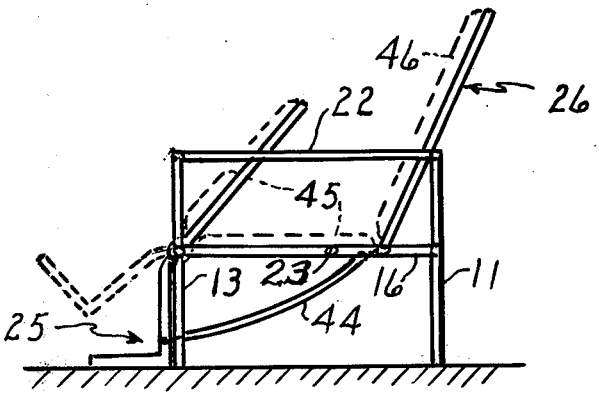
FIG. 2 illustrates a side elevational view of FIG. 1.

The chair 10 illustrated comprises a fixed framework 11 consisting of four legs 12, 13, 14 and 15 rigidly connected to four spacing supporting rails 16, 17, 18 and 19 and also rigidly connected to the top of the legs to a back rail 20 and two side arm rails 21 and 22. A seat support rail 23 is rigidly affixed at each end to rails 16 and 18 and preferably positioned so that a seat frame 25 will bear upon rail 23 in its lowered position. A backrest frame 26 comprised of upper cross bar 27 and two side bars 28 and 29 is pivotally attached at the open end of bars 28 and 29 by circular clamps or bearings 30 and 31 to a crossbar 32. Crossbar 32 being affixed at either end to rails 16 and 18. A seat frame 25 comprises a top crossbar 35 and two side bars 36 and 37. Bars 36 and 37 being affixed to a footrest 38. The bars 36 and 37 are provided with bearing apertures 39 and 40 to be mounted upon the rail 17 and the bars 36 and 37 are bent at the bearing point so that, in one position illustrated in FIGS. 1 and 2, the footrest 38 will rest flatly upon the ground or floor as the case may be. In the opposite position the bars 36 and 37 will rest upon the seat support rail 23 and the footrest will be raised from the floor as illustrated in dotted lines in FIG. 2. To assist the seat frame 25 in lifting from the dotted position shown in FIG. 2, there are a plurality of resilient straps 44 connected at one end to rail 32 and connected at the opposite end to the footrest 38. The footrest 38 is necessarily a solid boardlike structure. The seat frame 25 will be provided with a cushion 45 and the backrest frame 26 will be provided with a cushion 46. The chair 10 can be folded, that is, the seat frame 25 dropped down to bear on rail 23 and the backrest frame 26 can be folded over the seat frame making a compact chair for easy movement. However in use the seat frame 25 is dropped to the position illustrated in FIG. 1 and the backrest frame 26 is pivotally moved to bear against rail 20. In the use of the chair by an individual, they simply stand on the footrest 38 and grasp the two side rails 21 and 22 and move their body into contact with the cushion 45 of the seat frame and as their weight is transferred backward, the seat frame will tilt pivotally dropping the individual to the fully reclined position illustrated in dotted lines in FIG. 2 and vice versa when the individual wishes to rise again they grasp the rails 21 and 22 with their feet resting on the footrest 38 and move their body forward and as the weight is transferred the seat frame 25 is pivotally moved to the position illustrated in FIG. 1. The resilient straps 44 will stretch as the seat 45 moves downward to a reclining position tending to retard and prevent a jolting drop. The resilient straps due to being stretched for the reclining position will assist the individual when they move forward and start to rise, the straps pulling on the footrest and helping the individual to move into an erect position on the footrest.

Although the framework of the chair is provided with a pivotally supported seat and footrest element and is freely movable into either position, it may be essential to lock this frame in the reclining position. Therefore a locking arrangement is to be included in which simple snap locks may be provided on rail 23 to snap on and hold bars 36 and 37. Thus if the chair is used for a patient with nurse care it will be up to the nurse to release these snap locks before the patient can rise.

Although this invention has been described by specific structure, it will be obvious to one skilled in the art that many modifications may be constructed without departing from the invention. The scope of this invention is defined only in the appended claims.

What is claimed is:

1. An invalid chair for holding a patient in a sitting position comprising a single rigidly connected chair base frame formed with four upright supports joined in a square relationship by side, front and back rails and provided with a seat support rail, two side arm support rails connected to said four upright supports as a part of said single rigid frame, a cross bar extending between said side rails adjacent said seat support rail and a back rest frame pivotally connected to said crossbar, a single rigidly formed footrest and seat supporting frame pivotally mounted to said front rail, and resilient straps connected at one end to the footrest portion of said footrest and seat supporting frame and connected at the other end to said cross bar, whereby said straps resist the backward and downward movement of said seat portion of said footrest and seat supporting frame.

2. In a device according to claim 1 in which said single rigid footrest and seat supporting frame is movable from an upright position to a desired sitting position in toto by the shifting weight of a patient first standing on the footrest and leaning backward to be retarded by the patient using said side arms and rails and stopped when the patient reaches a sitting position with the legs bent downward and the feet slightly raised above the ground level.

3. In a device according to claim 1 in which said single footrest and seat supporting frame is movable in toto by the shifting weight of a patient moving the upper portion of his body forward from a prone position by means of said side arm rails to shift his or her weight over said front rail and allow said single footrest and seat support frame to be pivotally moved by said patient and pulled downward by said resilient straps until said footrest abuts with the floor leaving said patient in an upright position to permit said patient to dismount from said chair.

* * * * *